US006721620B2

(12) United States Patent
Jelali et al.

(10) Patent No.: US 6,721,620 B2
(45) Date of Patent: Apr. 13, 2004

(54) MULTI VARIABLE FLATNESS CONTROL SYSTEM

(75) Inventors: Mohieddine Jelali, Duisburg (DE); Ullrich Muller, Monheim am Rhein (DE); Gerd Thiemann, Bochum (DE); Andreas Wolff, Dusseldorf (DE)

(73) Assignee: BFI-VDEh-Institut fur angewandte Forschung GmbH, Dusseldorf (DE)

( * ) Notice: Subject to any disclaimer, the term of this patent is extended or adjusted under 35 U.S.C. 154(b) by 0 days.

(21) Appl. No.: 09/932,696

(22) Filed: Aug. 17, 2001

(65) Prior Publication Data

US 2002/0050070 A1 May 2, 2002

(30) Foreign Application Priority Data

Aug. 18, 2000 (DE) ..... 100 41 181

(51) Int. Cl.[7] ..... G06F 19/00

(52) U.S. Cl. ..... 700/148

(58) Field of Search ..... 700/148–156

(56) References Cited

U.S. PATENT DOCUMENTS

| | | | | | |
|---|---|---|---|---|---|
| 4,494,205 | A | * | 1/1985 | Dairiki et al. | 700/155 |
| 4,551,805 | A | | 11/1985 | Shimoda et al. | |
| 4,736,305 | A | * | 4/1988 | Watanabe | 700/154 |
| 5,535,129 | A | * | 7/1996 | Keijser | 700/148 |

FOREIGN PATENT DOCUMENTS

| | | |
|---|---|---|
| DE | 19758466 | 10/1998 |
| EP | 01119908.0-2302 | 3/1903 |
| EP | 0 063 605 A1 | 11/1982 |

OTHER PUBLICATIONS

Ralston, et al., "First Course in Numerical Analysis," International Series in Pure and Applied Mathematics, 1978, pp. 247–262, McGraw–Hill Book Company, New York, NY, USA.

Grimble, M.J., "The Design of Strip Shape Control Systems for Sendzimir Mills," IEE Transactions on Automatic Control, vol. AC–27, No. 3, Jun. 1982, pp. 656–665.

Ricker, N. Lawrence, "Use of Quadratic Programming for Constrained Internal Model Control," Ind. Eng. Chem. Process Des. Dev. 1985, vol. 24, pp. 925–936, University of Washington, Seattle, Washington USA.

Press, et al., "Numerical Recipes in C," The Art of Scientific Computing, Press Syndicaate Cambridge University Press, 1988, pp. 190–194, New York, NY, USA.

Van Gerwin, et al., "Development of Advanced Flatness Control for Hoogovens' Coldmill 21," Journal A: vol. 33, No. 4, 1992, pp. 24–32, The Netherlands.

Marcolini, Marco, "Mathematical Models for Flatness Control and Roll Settings—ABB Master Control of Sendzimir Mills," ABB Review, Jun. 7, 1993, pp. 17–28, Terni, Italy.

(List continued on next page.)

*Primary Examiner*—Leo Picard
*Assistant Examiner*—W. Russell Swindell
(74) *Attorney, Agent, or Firm*—Cook, Alex, McFarron, Manzo, Cummings & Mehler, Ltd.

(57) ABSTRACT

Method of measuring and/or controlling flatness during rolling. The flatness deviation is measured and expressed using orthogonal polynomials. A controlled variable is generated using an Internal Mode Control by comparing the expressed deviation with values of orthogonal polynomials supplied by a model. The comparison provides a control difference to control variables that influence bending, pivoting and axial displacement of the rolls and by multizone cooling.

4 Claims, 4 Drawing Sheets

OTHER PUBLICATIONS

Morari, et al., "Model Predictive Control Toolbox For Use with MATLAB," User's Guide, Version 1, 1995, printed version, 1998—on–line version The MathWorks, Inc. (www.mathworks.com), Natick, MA, USA.

Hoshino, et al., "Observer–based Multivariable Control of Rolling Mills," IFAC Automatic in Mining, Mineral and Metal Processing, 1998, pp. 251–256, Cologne, Germany.

Pu, et al., and Kern, et al., "State–Observer Design and Verification Towards Developing a Integrated Flatness–Thickness Control System for the 20 Roll Senddzimir Cluster Mill," Proceedings of the 7th Int'l. Conference on Steel Rolling (STEEL ROLLING '98), 1998, pp. 124–129 Chiba, Japan.

Soda, et al., "Improvement in Flatness Control Response for Tandem Cold Strip Mill," Proceedings of the 7th International Conference on Steel Rolling (STEEL ROLLING '98), The Iron and Steel Institute of Japan, 1998, pp. 760–765, Chiba, Japan.

Ringwood, John V., "Shape Control Systems for Sendzimir Steel Mills," IEEE Transactions On Control Systems Technology, Jan. 2000, vol. 8, No. 1, pp. 70–86.

Branicky, et al., "Stability of Networked Control Systems: Explicit Analysis of Delay," Proceedings of the American Control Conference, Jun., 2000, pp. 2352–2357, Chicago, Illinois, USA.

DeCarlo, et al., Perspectives and Results on the Stability and Stabilizability of Hybrid Systems, Proceedings of the IEEE Transactions On Control Systems Technology, Jul. 2000, vol. 88, No. 7, pp. 1069–1082.

Pu, et al., "The Hardware–In–Loop Simulation and On–Line Test of an Integrated Thickness and Flatness Control System for the 20 Rolls Sendzimir Cold Running Mill," pp. 208–216, Germany.

McDonald, et al., "Advances in flatness Control Technology," pp. 161–169.

Schneider, et al., "Model Supported Profile and Flatness Control Systems," MDS Mannesmann Demag Sack GmbH, pp. 49–60, Ratingen, Germany.

Rivera, D.E., "ChE 461/598: Process Dynamics and Control; Introduction to Internal Model Control with Application to PID Controller Tuning," 1999, pp. 1–9.

* cited by examiner

MULTI VARIABLE FLATNESS CONTROL SYSTEM

The invention relates to a method of measuring and/or controlling the flatness of a strip during rolling.

BACKGROUND OF THE INVENTION

During strip rolling, obtaining the optimum flatness and shape of the strip represents a particular problem. In this connection, it is advantageous that the rough strip already largely has the envisaged strip profile and runs centrally into the finishing roll train. In addition, the passes in the individual stands should be carried out in such a way that a respectively uniform strip extension over the entire strip width is obtained in all the stands. Furthermore, the aim is a reduction in the strip length (in the finished product) whose flatness lies outside the tolerance. This applies in particular to the head and tail of the strip.

For this purpose, it is known to determine the length distribution of the rolled metal sheet by means of a flatness measuring system (see FIG. 1). The various types of errors—for example central waves, edge waves, quarter waves or flatness defects of higher order—are determined by means of mathematical analysis of the measured length distribution, in order specifically to employ the suitable actuating elements for error correction.

The length distribution is represented with the aid of a conventional polynomial:

$$p(x)=a_0+a_1x+a_2x^2+a_3x^3+a_4x^4$$

Here, edge waves on the left-hand or right-hand side of the strip are described by the coefficients $a_1$ and $a_3$. The coefficients $a_2$ and $a_4$ describe either symmetrical central waves or symmetrical edge waves at the left-band and right-hand side of the strip. The coefficients $a_1$ and $a_3$, and $a_2$ and $a_4$ therefore contain common information components.

Hitherto, at least in most practical implementations of flatness control, use has primarily been made of the coefficients (also referred to below as components) $a_1$ and $a_2$.

To control the flatness on the finishing roll line, use is mostly made of the manipulated variables relating to working-roll bending in order to control the components $a_2$ and $a_4$, and the hydraulic settings on the operator and drive sides (pivoting) to eliminate the error components $a_1$ and $a_3$. For the purpose of control, therefore, the coefficients $a_1$ and $a_3$ are used as the controlled variable for the pivoting, and the coefficients $a_2$ and $a_4$ are used as the controlled variable for the bending.

In some rolling stands, the axial displacement of the working rolls is primarily used to preset the roll gap contour and only in some cases, within the control loop, is used in combination with bending to correct the quarter waves. Finally, selective multizone cooling of the working rolls can permit the flatness errors of higher order to be corrected. A control system of this type is disclosed, for example, by the German Patent Application DE 197 58 466 A1.

In each case, the manipulated variables are calculated by means of a setting of the rolling force and the bending force predefined by a setup calculation. The controllers used are known PI controllers but these are not able to take the dead times of the section into account explicitly. Consequently, a weak setting of the controller gains, in particular of the I component, has to be made, in order to avoid instabilities in the control loop.

This control system is not able to satisfy the increase in quality demands on flatness, since the flatness control reaches its intended curve only after a relatively long time. This results in the fact that, firstly it is necessary to tolerate a long strip length whose flatness lies outside the tolerance. Often, however, the intended curve is not reached at all, but only to an approximation, so that large edge and center waves can be produced.

Moreover, it is disadvantageous that $a_0$, $a_1$, $a_2$, $a_3$ and $a_4$ exert mutual influence on one another, and the dead times are not taken into account, that is to say not compensated for. Furthermore, the actuating element characteristics (influencing functions) are calculated only once for each strip and are assumed to be constant, since iterative model equations are used for the calculation.

On the basis of the classical flatness control described previously, expansions to the classical control concept have already been proposed, in order to eliminate the existing disadvantages to some extent.

Breaking down the measured flatness in the direction of influencing functions which are not orthogonal to one another is described in Schneider, A.; Kern, P.; Steffens, M.: Model Supported Profile and Flatness Control Systems, Proc. of 49° Congresso Internaciona de Tecnologia Metalurgica e de Materials—International Conference, Oct. 9–14 1994, São Paulo, Vol. 6, p. 49/60 und McDonald, I. R.; Mason, J. D.: Advances in flatness control technology, Proc. of the Conf. on the Control of Profile and Flatness, Mar. 25–27 1996, The Institute of Materials, Birmingham, p. 161/170. Improved results can be achieved by this method, but in the case of redundant and very similar manipulated variables, because of the poor conditioning of the system (poorly invertible systems), very large manipulated variables occur. This can result in very high stress levels.

In Grimble, M. J.; Fotakis, J.: The Design of Strip shape Control Systems for Sendzimir Mills, IEEE Trans. on Automatic Control 27 (1992) no. 3, p. 656/666 und Ringwood, J. V.: Shape Control Systems for Sendzimir Steel Mills, IEEE Trans. on Control Systems Technology 8 (2000) no. 1, p. 70/86., a flatness control system for Sendzimir rolling stands with orthogonal decomposition of the flatness values into Chebyshev polynomials is proposed, in order to improve the flatness control, but in this case, dead time compensation and manipulated variable restrictions are not taken into account. In this case, the manipulated variables are determined by means of a multivariable controller. The multivariable controller is not designed to be capable of on-line dynamic optimization.

Flatness control by means of an observer and classical state controller is presented in Hoshino, I.; Kimura, H.: Observer-based multivariable control of rolling mills, Preprints of the IFAC Workshop on Automation in Mining, Mineral and Metal Processing, Sep. 1–3 1998, Cologne, p. 251/256. An expansion to nonlinear models and dynamic optimization can be found in Pu, H.: Nern, H.-J.; Roemer, R.; Nour Eldin, H. A.; Kern, P.; Jelali, M.: State-observer design and verification towards developing an integrated flatness-thickness control system for the 20 roll sendzimir cluster mill, Proc. Intern. Conf. on Steel Rolling (Steel Rolling '98), Nov. 9–11 1998, The Iron and Steel Institute of Japan, Chiba, p. 124/29 und Pu, H.; Nern, H.-J.; Nour Eldin, H. A.; Jelali M.; Totz, O.; Kern, P.: The Hardware-in-Loop simulations and on-line tests of an integrated thickness and flatness control system for the 20 rolls sendzimir cold rolling mill, Proc. Intern. Conf. on Modelling of Metal Rolling Processes, Dec. 13–15 1999, London, p. 208/16. In the case of these solutions, however, the flatness is not broken down into orthogonal polynomials. Nor are the dead times compensated for in these approaches.

Improving the flatness control by compensating for the dead time by means of a Smith predictor is described in Soda, K.; Amanuma, Y.; Tsuchii, K.; Ohno, S.; N.: Improvement in Flatness Control Response for Tandem Cold Strip Mill, Proc. Intern. Conf. on Steel Rolling (Steel Rolling '98), Nov. 9–11 1998, The Iron and Steel Institute of Japan, Chiba, p. 760/765. In this case, the predictor calculates the control variables which occur in the first sampling step after the dead time has elapsed, and therefore compensates for the dead time. Flatness is broken down along the influencing functions. In the case of redundant and very similar manipulated variables, because of the poor conditioning of the system (poorly invertible systems), very large manipulated variables occur. As a result, the plant can be excessively stressed. A classical multivariable controller (PID controller) is integrated in the Smith predictor. There is no dynamic optimization with prediction of the course of the controlled variable going beyond the dead time. Here, a controlled variable is predicted which occurs directly in the first sampling step after the dead time.

In many conventional flatness measuring systems, measured values are supplied at predetermined sample times. When time-discrete controllers are used, for example PI controllers, it is assumed that the sampling time is constant. If the sampling time is not kept constant the control result is impaired or the control loop even becomes unstable.

BRIEF SUMMARY OF THE INVENTION

Accordingly, the invention is based on the object of providing a method which permits the measurement and/or control of the flatness of a strip during rolling in a reliable manner. In addition, an apparatus for implementing this method is to be provided.

This object is achieved by a method of measuring and/or controlling the flatness of a strip during rolling, wherein the measured values are broken down into independent components, an apparatus for measuring and/or controlling the flatness of a strip for implementing the method and having a measuring system for registering the flatness deviation (measured values and a unit for breaking down the measured values into independent components; and a flatness control system that includes registering the flatness of the strip with a measuring system; breaking down the flatness errors (length distribution) into orthogonal components; an explicit on-line-capable profile and flatness model, which takes into account all the variables involved in the rolling process; an explicit on-line capable model, which calculates set points for the flatness control system; a multi-variable controller to control the flatness of the strip; a prediction of the controlled variables (flatness values), which is incorporated into the dynamic optimization, which goes beyond dead time; and interference variable feed forward, which takes account of the properties of the incoming strip, the variation in rolling force and thermal chambering. Advantageous developments form the subject of the subclaims.

Here, the invention is based on the idea of improving the flatness control according to the prior art by means of an orthogonal, model-supported multivariable flatness control system with the flatness being registered and broken down into orthogonal components. The multivariable flatness control system preferably includes determination of the manipulated variables by means of dynamic on-line optimization, taking manipulated variable restrictions into account, and prediction of the controlled variables (flatness values), which are incorporated into dynamic optimization. The prediction of the controlled variables goes beyond the dead time. In the model-based predictive approach, prediction of the controlled variables from the first sampling step after the dead time as far as a prediction horizon is used. By this means, at every time, optimal manipulated variables are calculated, even if the time constants of the individual actuating elements are considerably different. This information is preferably likewise incorporated into the dynamic optimization.

The components can advantageously be compared with values which are supplied by an on-line-capable model of the plant. The resulting difference can be used as controlled variable and subsequently compared with the intended flatness curve broken down into independent components. The resulting control difference can be fed to a multivariable controller via an optimal decoupling means.

In the method according to the invention, it is particularly advantageous that the dead time can be taken into account by the internal model control (IMC) approach. As a result, the control time can be shortened and the strip length which lies outside the tolerance range can be reduced.

By breaking down the flatness measured values into independent components, it is additionally possible for the respective flatness errors to be clearly identified which permits a considerable improvement in the quality of control.

Likewise, it is an advantage that, by means of the orthogonal breakdown of the flatness, the number and form of the necessary manipulated variables can be determined.

The method according to the invention further permits the change in the rolling force, the thermal cambering and the incoming strip properties to be taken into account during each time step by means of interference variable feedforward.

Furthermore, it has the advantage that it permits the nonlinearities of the plant to be taken into account on-line explicitly by means of an on-line-capable model of the plant which is in parallel with the section.

The method according to the invention and the associated system advantageously take into account flatness measuring systems with time variant sampling time by means of an IMC (Internal Model Control) approach with an event generator and event-triggered sample-and-hold elements.

In an advantageous embodiment, the multivariable flatness control system according to the invention comprises the following steps:

- registering the flatness of the strip with a measuring system,
- breaking down the flatness errors (length distribution) into orthogonal components,
- an explicit, linear or nonlinear on-line-capable profile and flatness model, which takes into account all the significant variables involved in the rolling process (bending, pivoting, displacement, thermal cambering and so on);
- an explicit on-line-capable model which calculates setpoints for the flatness control system,
- a multivariable controller for controlling the flatness of the strip
- a prediction of the controlled variables (flatness values), which is incorporated into the dynamic optimization, which goes beyond the dead time,
- interference variable feedforward, which takes account of the properties of the incoming strip, the variation in rolling force and thermal cambering, and
- an event-triggered sampling system for taking account of flatness measuring systems with variable sampling time.

The components can advantageously be broken down by using orthogonal polynomials, for example with the aid of Chebyshev polynomials or Gram polynomials, as described in W. H. Press, S. A. Teukolsky, W. T. Vetterling, B. P. Flannery: Numerical Recipes in C, Cambridge University Press (1992) oder A. Ralston, P. Rabinowitz: A first course in numerical analysis, International series in pure applied mathematics, McGraw-Hill (1978).

The flatness of the outgoing metal sheet can be influenced by bending, pivoting and axial displacement of the rolls and by selective multizone cooling. The individual manipulated variables can be determined from the above-described control difference with the aid of a multivariable controller. At the same time, the influence of the rolling force, the incoming strip properties and thermal cambering can be compensated for by means of interference variable feedforward.

DETAILED DESCRIPTION OF THE INVENTION

Figure 1:
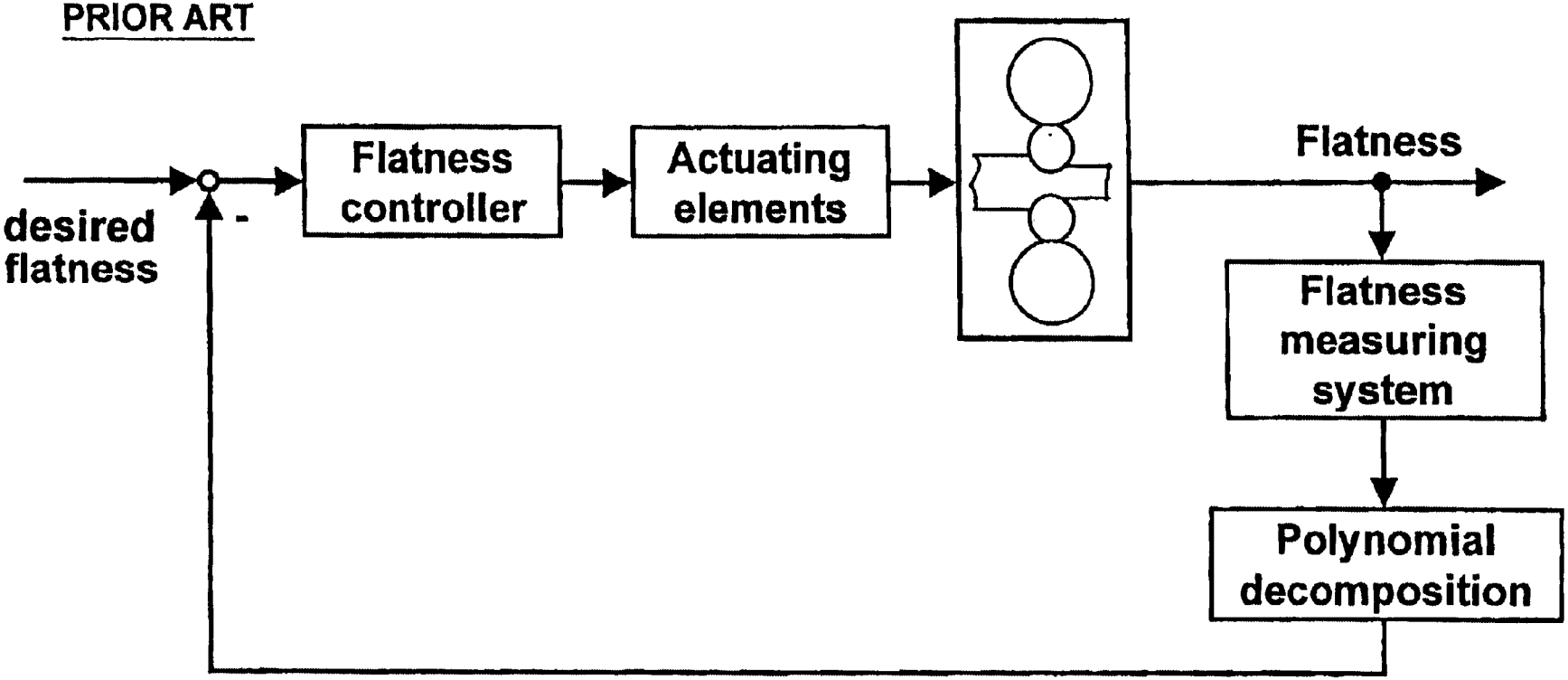
Fig. 1 PRIOR ART
FIG. 1 shows an illustration of flatness control system according to the prior art and FIG. 2 shows an illustration of the method according to the invention for the model-assisted predictive multivariable flatness control of strip with the measured flatness being broken down into orthogonal components, interference variable feedforward and dynamic optimization taking account of restrictions.
Figure 2:
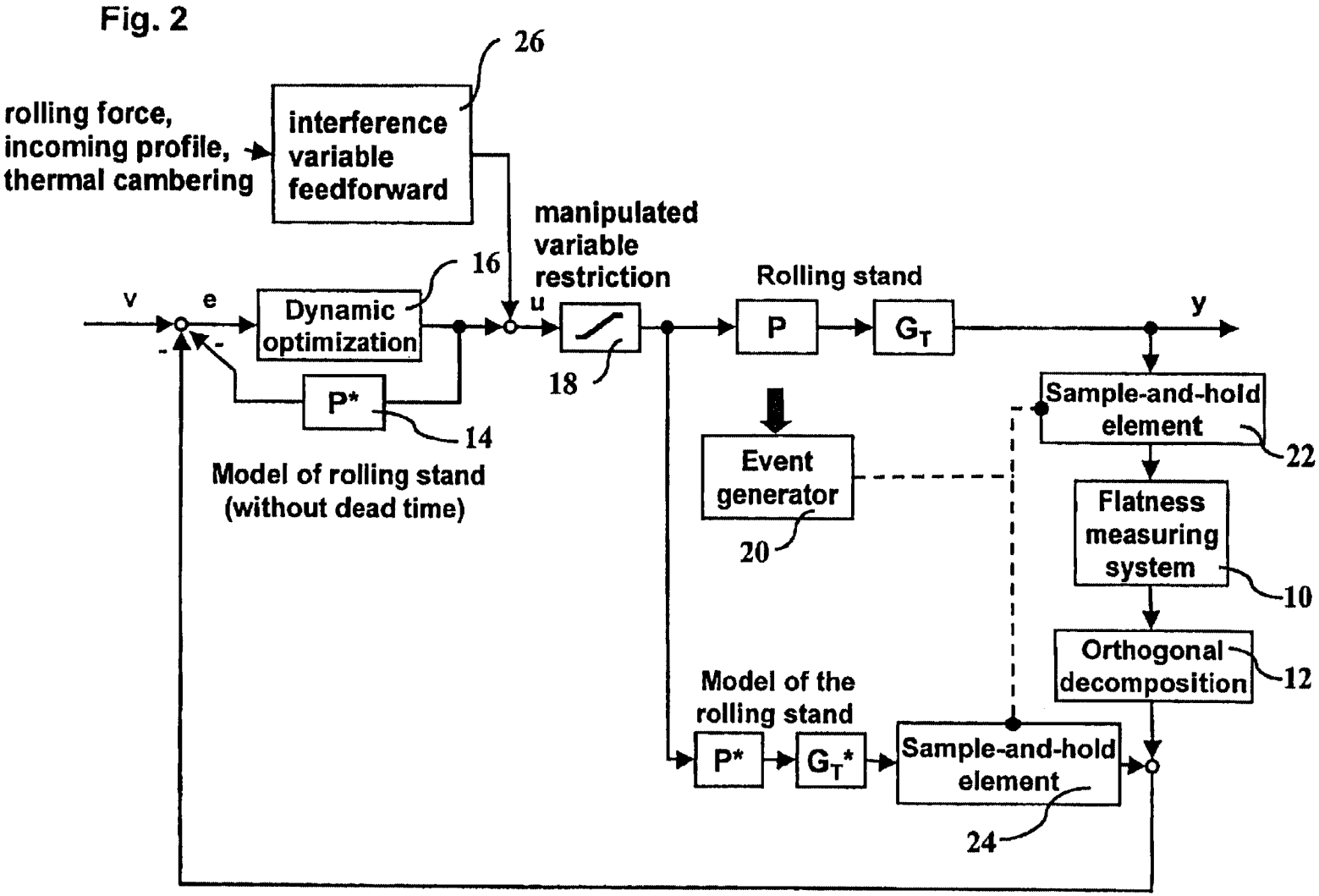
Figure 3A:
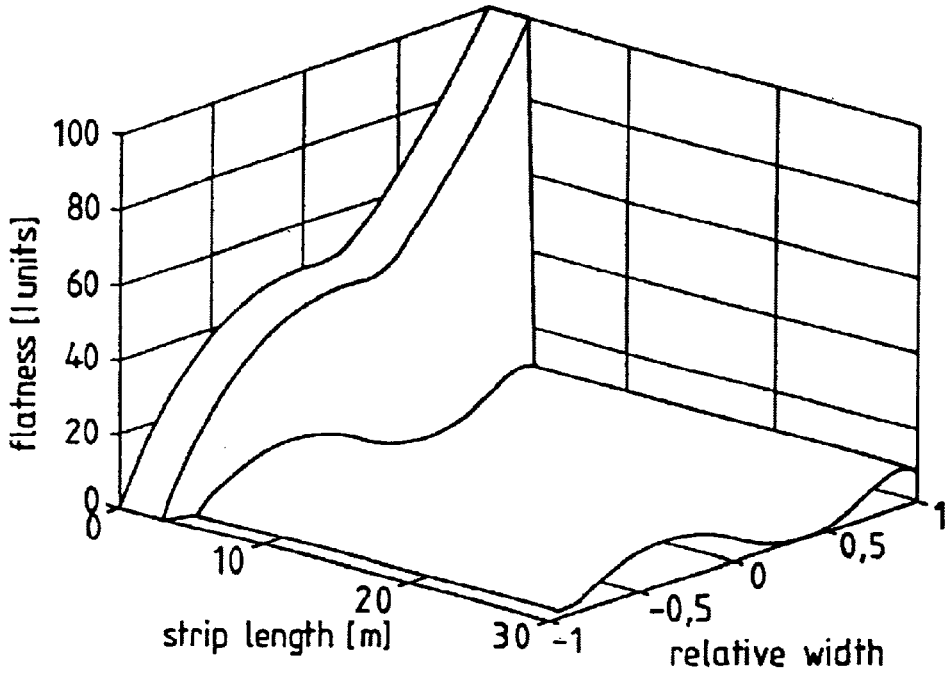
FIG. 3*a* shows a diagram of a control result in a conventional control system.
Figure 3B:
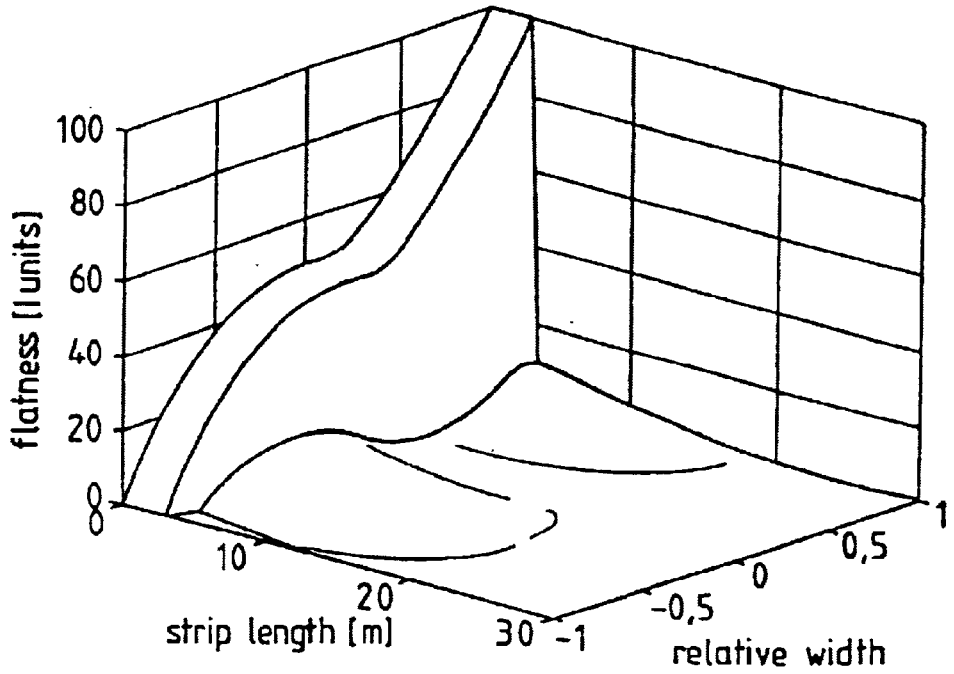
FIG. 3*b* shows a diagram of a control result in a control system according to the invention.

As FIG. 2 shows, the flatness deviation is determined by means of a measuring system and then broken down into orthogonal (independent) components (see 12). The components are compared with values which are supplied by an on-line-capable model of the plant. The resulting difference is used as the controlled variable. This is then compared with the intended flatness curve, broken down into independent components, and the resulting control difference is fed to a multivariable controller, comprising an on-line-capable model 14 and dynamic optimization 16 incorporating manipulated variable restrictions 18 and the predicted course of the controlled variables. In order to take account of flatness measuring systems with a variable sampling time, an event-triggered sampling system having an event generator 20 which interacts with two sample-and-hold elements 22 and 24 is provided.

The flatness of the outgoing metal sheet is influenced by bending, pivoting and axial displacement of the rolls and also by selective multizone cooling. The individual manipulated variables are determined from the above-described control difference with the aid of a multivariable controller. At the same time, the influence of the rolling force, the incoming strip properties and thermal cambering is compensated for by interference variable feedforward 26.

By way of example, the advantages of the new concept as compared with the prior art are represented on the basis of simulations in FIGS. 3*a*, 3*b*, 4*a* and 4*b*. Here, a model of a Sendzimier rolling stand with very different time constants in the actuating elements is used. A flatness error resulting from the wrong mutual displacement of the conical rolls is assumed. The new concept controls out the flatness error after about 30 m strip length (see FIG. 3*b*), while in the case of the current concept, a residual flatness error of 10 I units remains (see FIG. 3*a*). This residual error disappears only after about 300 m strip length. The reason for this is that the current concept does not use dynamic optimization taking into account the predicted controlled variables going beyond the dead time.

Figure 4A:
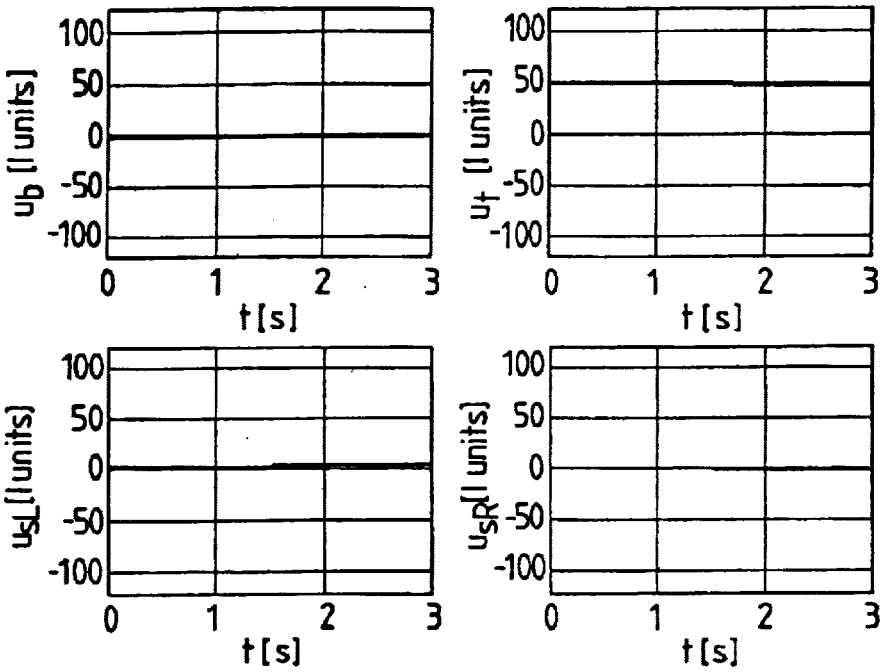
FIG. 4*a* shows manipulated variable diagrams in a conventional control system.
Figure 4B:
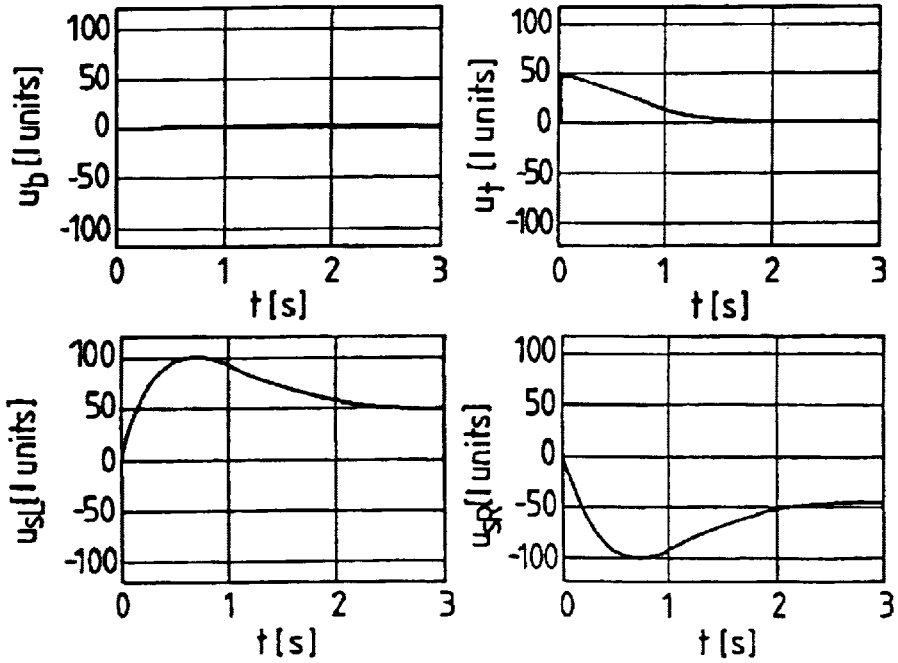
FIG. 4*b* shows manipulated variable diagrams in a control system according to the invention.

From the course of the manipulated variables in FIG. 4*b*, it can be seen that the multivariable flatness system according to the invention first addresses the bending and pivoting and then tracks the slow conical rolls in order to control out the flatness error, and therefore determines optimum manipulated variables at every time. The current concept (see FIG. 4*a*) does not manage to address the conical rolls with the necessary speed and therefore control out the flatness error.

We claim:

1. A method for controlling the flatness of a strip during rolling by means of bending, pivoting and axial displacement of rolls and by selective multizone cooling, comprising:

measuring the flatness deviation by means of a measuring system with an event-triggered sample and hold system;

expressing the measured flatness deviation using orthogonal polynomials;

generating a controlled variable using an Internal Model Control structure (IMC), by comparing such expressed flatness deviation with values of orthogonal polynomials supplied by an on-line-capable model of the plant;

generating a control difference by comparing the controlled variable with an intended flatness curve, said intended flatness curve being expressed using orthogonal polynomials;

feeding the control difference to a multivariable controller that comprises an on-line-capable model and a dynamic optimization incorporating manipulated variable restrictions and the predicted course of the controlled variables;

wherein the multivariable controller determines manipulated variables that influence the bending, pivoting and axial displacement of the rolls and by selective multizone cooling.

2. The method as claimed in claim 1, which comprises interference variable feedforward.

3. The method as claimed in claim 1, comprising feeding the control difference to the multivariable controller via a decoupling means.

4. The method as claimed in claim 1, wherein the predicted course of the controlled variables going beyond the dead time is incorporated into the dynamic optimization.

* * * * *